US008083252B2

(12) United States Patent
Wagner et al.

(10) Patent No.: US 8,083,252 B2
(45) Date of Patent: Dec. 27, 2011

(54) CROSS-FRAME WHEELCHAIR WITH FOLDABLE SEAT AND BACK

(76) Inventors: Mary Jo Wagner, Beverly, MA (US); Steven Tidcomb, Beverly, MA (US)

( * ) Notice: Subject to any disclaimer, the term of this patent is extended or adjusted under 35 U.S.C. 154(b) by 261 days.

(21) Appl. No.: 12/408,668

(22) Filed: Mar. 20, 2009

(65) Prior Publication Data

US 2010/0194077 A1 Aug. 5, 2010

Related U.S. Application Data

(60) Provisional application No. 61/038,308, filed on Mar. 20, 2008.

(51) Int. Cl.
*A61G 5/08* (2006.01)

(52) U.S. Cl. ..... 280/650; 280/280.1; 297/42; 297/44; 297/45

(58) Field of Classification Search ..... 280/250.1, 280/650, 47.41, 647, 639; 297/DIG. 4, 42, 297/45, 44

See application file for complete search history.

(56) References Cited

U.S. PATENT DOCUMENTS

| | | | | | |
|---|---|---|---|---|---|
| 2,669,289 | A | * | 2/1954 | Usher et al. | 248/436 |
| 2,847,058 | A | * | 8/1958 | Lee | 297/44 |
| 3,337,261 | A | * | 8/1967 | Nihlean et al. | 297/44 |
| 4,026,568 | A | * | 5/1977 | Hallam | 280/42 |
| 4,629,246 | A | | 12/1986 | Fulton | |
| 4,770,432 | A | | 9/1988 | Wagner | |
| 4,796,948 | A | * | 1/1989 | Paul et al. | 297/284.1 |
| 4,917,395 | A | * | 4/1990 | Gabriele | 280/250.1 |
| 4,989,890 | A | * | 2/1991 | Lockard et al. | 280/42 |
| 5,244,222 | A | | 9/1993 | Benoit | |
| 5,285,535 | A | * | 2/1994 | Stewart et al. | 4/480 |
| 5,607,202 | A | | 3/1997 | Toso et al. | |
| 6,135,475 | A | | 10/2000 | Brown et al. | |
| 6,241,275 | B1 | * | 6/2001 | Slagerman | 280/650 |
| 6,352,275 | B1 | | 3/2002 | Lindenkamp | |
| 7,364,228 | B2 | * | 4/2008 | Entz | 297/44 |
| 2005/0067861 | A1 | | 3/2005 | Avihod | |

FOREIGN PATENT DOCUMENTS

| | | | | |
|---|---|---|---|---|
| DE | 3431723 | | | 2/1986 |
| EP | 248093 | A1 | * | 12/1987 |
| EP | 1797854 | A1 | * | 6/2007 |
| FR | 2252838 | A | * | 8/1975 |
| GB | 2243289 | A | * | 10/1991 |
| JP | 10-192081 | A | * | 7/1998 |
| JP | 11-239590 | A | * | 9/1999 |
| JP | 2001-187090 | A | * | 12/1999 |
| JP | 2001-276141 | A | * | 10/2001 |
| WO | WO 99/37265 | | * | 7/1999 |
| WO | WO2006044634 | | | 4/2006 |

* cited by examiner

*Primary Examiner* — Ruth Ilan
(74) *Attorney, Agent, or Firm* — O'Connell Law Firm

(57) ABSTRACT

A foldable, cross-frame wheelchair with a foldable seat and foldable seatback. The foldable seat has a first outside edge retained relative to a longitudinal frame member at a second, upper end of a first cross-frame member of the wheelchair frame and a second outside edge retained relative to a longitudinal frame member at a second, upper end of a second cross-frame member of the wheelchair frame. A longitudinal hinge portion is interposed between the first and second outside edges to divide the seat into first and second pivotally coupled members. The hinge portion can be disposed to the obverse side of the first and second members of the seat. The foldable seatback can be divided into upper and lower foldable seatbacks.

15 Claims, 8 Drawing Sheets

CROSS-FRAME WHEELCHAIR WITH FOLDABLE SEAT AND BACK

FIELD OF THE INVENTION

The present invention relates generally to foldable occupant seating arrangements. More particularly, disclosed and protected herein are seat and back arrangements and cross-frame chairs incorporating the same that are foldable between storage and use configurations thereby facilitating portability while providing comfortable, ergonomic support to the seat occupant.

BACKGROUND OF THE INVENTION

Typical foldable wheelchairs support the seat occupant with a sling-like seat and back extending between the two sides of the wheelchair. The side frames of the wheelchair are joined by a cross-frame assembly that performs a scissor-like folding movement. With this, the wheelchair can be adjusted between a use configuration and a folded configuration for storage and transport.

Unfortunately, the sling seats and backs typical of the prior art are ergonomically incorrect and produce discomfort and poor posture, particularly when used for extended periods of time. Indeed, studies have shown that prolonged use of sling-style chairs have produced negative effects on the seat occupant's posture, comfort, and overall health. In certain cases, extended use of sling-style seats and backs has resulted in pressure sores, a curving of the spine into a kyphotic geometry, and a posterior tilting of the pelvis thereby causing further discomfort and maladies.

It is generally agreed that a person's back and posterior are best supported by a resilient cushion having sufficient rigidity to prevent the bowing and resultant discomfort inherently produced by sling seats and backs. Accordingly, the prior art has sought to remedy the deficiencies of sling arrangements by the use of removable seat and back cushions that use the sling arrangement as a support base. The removable cushions are normally sold as after-market accessories.

While such arrangements can provide a seat occupant with much needed support, the removable cushions suffer from a number of drawbacks. For example, the user must remove the cushion prior to folding the wheelchair, find a place to place the cushion during transport or storage, and then reinstall the cushion when the chair is again ready to be used. Furthermore, such cushions often fail to stay in a fixed position whereby they, and possibly the seat occupant, slide into a disadvantageous and uncomfortable position. Still further, the removable cushions can be lost, damaged or soiled, or reinstalled incorrectly.

In light of the foregoing, it becomes clear that there remains a need in the art for ergonomic foldable seat and back cushions for use in relation to folding chair constructions that provide comfortable, ergonomically sound support while enabling the chair to be folded for storage and transport without a need for being removed from the chair frame.

SUMMARY OF THE INVENTION

Advantageously, the present invention is founded on the basic object of providing a foldable seat and foldable seatback that provides comfortable, ergonomic support to a seat occupant when in use but that readily folds to enable a folding of the chair without a need for removing the cushion.

It is a further object of the invention to provide a foldable seat and foldable seatback arrangement that effectively replaces standard wheelchair sling upholstery or uncomfortable rigid supports with an advanced, clinically advantageous configuration.

Another object of embodiments of the invention is to provide a foldable seat and foldable seatback that can be removed and replaced for cleaning and replacement.

In certain embodiments, a further object of the invention is to provide foldable seat and seatbacks that have contoured shapes for optimal comfort, skin protection, and body positioning.

Another object of the invention is to provide foldable seats and seatbacks that can be associated with detachable materials for relief of orthopedic deformities or postural asymmetries.

Yet another object of embodiments of the invention is to provide a foldable seat and seatback that can be attached to a chair in a variety of ways to accommodate varied chair designs.

These and further objects and advantages of embodiments of the invention will become obvious not only to one who reviews the present specification and drawings but also to one who has an opportunity to make use of an embodiment of the instant invention for a wheelchair with a foldable seat and seatback as disclosed herein. The accomplishment of each of the foregoing objects in a single embodiment of the invention may be possible and indeed preferred. However, it will be appreciated that not all embodiments will seek or need to accomplish each and every potential object and advantage. Nonetheless, all such embodiments should be considered within the scope of the present invention.

In carrying forth these objects, a basic embodiment of the invention essentially comprises a foldable wheelchair frame with a foldable seat retained relative to the foldable wheelchair frame. The foldable frame has a first side frame, a second side frame, and a cross-frame arrangement interposed between the first and second side frames. The cross-frame arrangement is formed by first and second cross-frame members. The first cross-frame member has a lower, first end pivotally coupled to the first side frame, the second cross-frame member has a lower, first end pivotally coupled to the second side frame, and the first and second cross-frame members are pivotally coupled to one another at mid-portions thereof.

The foldable seat has a first outside edge, a second outside edge, and a longitudinal hinge portion interposed between the first and second outside edges to divide the seat into first and second members that are pivotally coupled at a hinge portion. The first outside edge is retained relative to the second end of the first cross-frame member, and the second outside edge is retained relative to the second end of the second cross-frame member. Under this arrangement, the foldable wheelchair frame can be adjusted from a use configuration to a folded configuration by a movement of the first and second side frames toward one another to induce a pivoting of the cross-frame members, a resultant raising of the second ends of the cross-frame members in relation to the side frames, and a drawing together of the second ends of the cross-frame members. This, in turn, yields a raising of the first and second outside edges of the seat in relation to the side frames and a folding of the foldable seat about the hinge portion.

The wheelchair frame can further include a first longitudinal frame member retained at the upper, second end of the first cross-frame member and a second longitudinal frame member retained at the upper, second end of the second cross-frame member. Under this construction, the first and second outside edges of the foldable seat can be coupled to the first and second longitudinal frame members respectively. In certain embodiments, the first and second outside edges of the foldable seat can be coupled to the first and second longitudinal frame members by sleeves disposed over the first and second longitudinal frame members.

Each of the first and second members of the seat can be considered to have a support surface disposed to support a seat occupant, an obverse side disposed to face away from the seat occupant, and a given thickness between the support surface and the obverse surface. The hinge portion can then be disposed to the obverse side of the first and second members of the seat thereby to prevent pinching of the seat occupant and to cause the foldable seat to tend to fold upwardly and out of interference with the folding of the chair frame.

The first and second members of the seat can each have a resiliently compressible body portion, which can possibly be reinforced by a rigidifying panel. In certain embodiments, each of the first and second members of the seat can have an open inner volume and an aperture fluidically associated therewith for enabling the insertion and removal of fluid from the open inner volume.

The hinge portion can take any suitable form. In one embodiment, for example, the hinge portion is formed by a butt-style hinge with a central body portion that communicates longitudinally along a midline between the first and second members of the seat, a first wing fixed to the first member, and a second wing fixed to the second member. In other cases, the hinge portion can be formed by at least one longitudinal furrow in the foldable seat between the first and second members of the seat. The furrow can be disposed to a support surface side of the foldable seat or to the obverse side of the foldable seat. Alternatively, one or more furrows can be disposed to the support surface side of the foldable seat and to the obverse side of the foldable seat. Still further, the hinge could be formed by a longitudinal void disposed in the foldable seat between the first and second members of the seat, by a disparate material disposed in the foldable seat between the first and second members of the seat, or by a flexible base web fastened to the first and second members of the seat.

While the foldable seat could be employed alone, it is also possible to retain the foldable seat relative to a flexible seat of the wheelchair frame that has a first outside edge retained relative to the second end of the first cross-frame member and a second outside edge retained relative to the second end of the second cross-frame member. Any appropriate mechanism would be possible, including a combination of hook and loop material disposed on the obverse side of the foldable seat and an upper side of the flexible seat.

One will appreciate that the foregoing discussion broadly outlines the more important goals and features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

It will be appreciated that the cross-frame wheelchair with a foldable seat and seatback as disclosed herein is subject to widely varied embodiments. However, to ensure that one skilled in the art will be able to understand and, in appropriate cases, practice the present invention, certain preferred embodiments of the broader invention revealed herein are described below and shown in the accompanying drawing figures. Before any particular embodiment of the invention is explained in detail, it must be made clear that the following details of construction, descriptions of geometry, and illustrations of inventive concepts are mere examples of the many possible manifestations of the invention.

Figure 1:
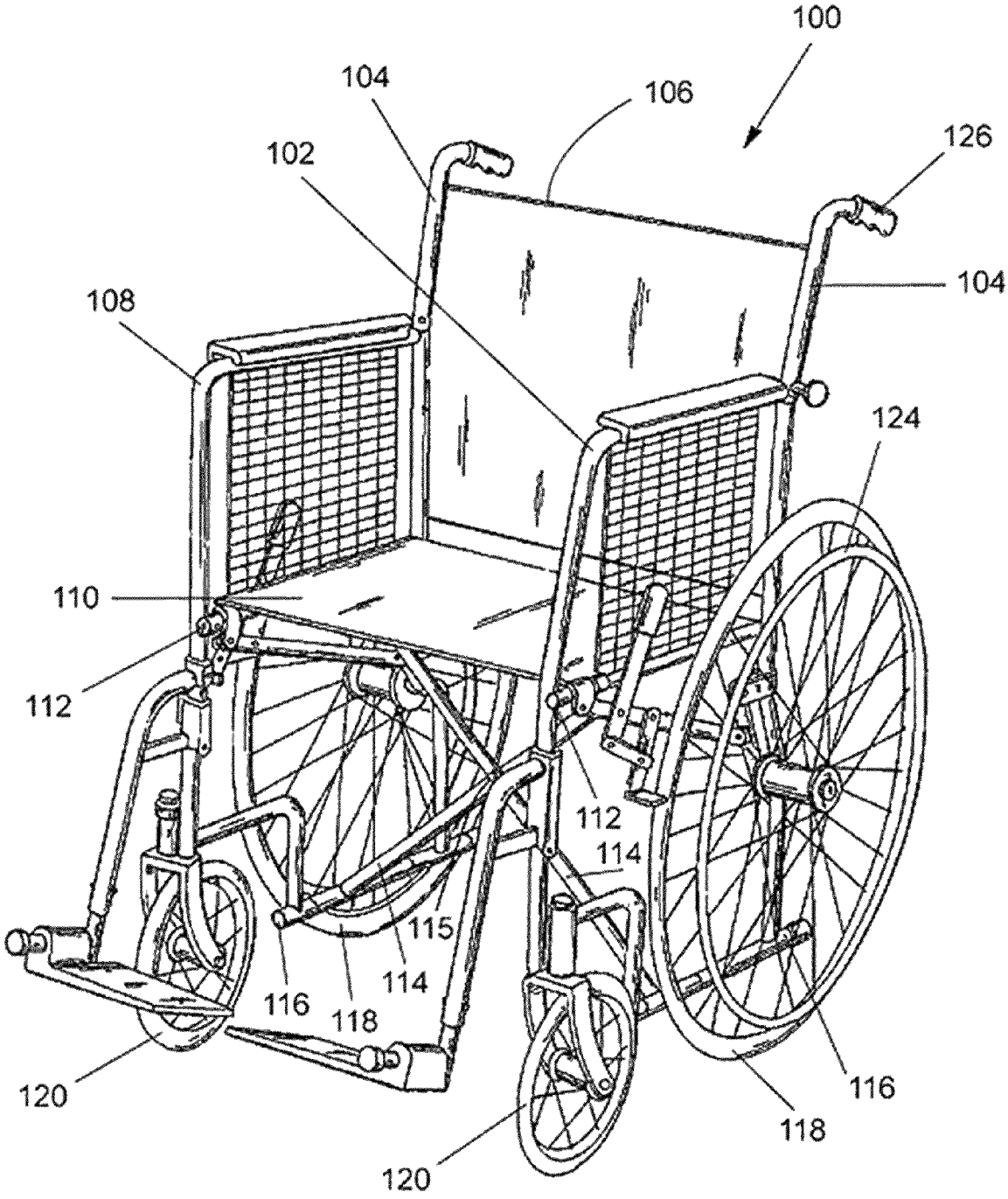
FIG. 1 PRIOR ART
FIG. 1 is a perspective view of a prior art foldable cross-frame wheelchair employing sling-style seat and back cushions.

Looking more particularly to the drawings, a typical foldable wheelchair according to the prior art is indicated generally at 100 in FIG. 1. The wheelchair 100 has a frame supported by rear wheels 118 and steerable front wheels 120. The wheelchair 100 is capable of occupant propulsion by use of annular rails 124 affixed to the rear wheels 118 or assistive propulsion by a person's gripping of the handle portions 126 of canes 104. The wheelchair 100 has first and second side frames 102 and 108 that are foldable into and out of proximity with one another by use of a cross-frame scissor arrangement employing pivotally coupled first and second cross-frame members 114. More particularly, each cross-frame member 114 typically has a lower end pivotally coupled to a lower longitudinal frame member 116 of a side frame 102 or 108, a body portion traversing between the side frames 102 and 108, and an upper end that retains an upper longitudinal frame member 112. The cross-frame members 114 can be pivotally coupled to one another at a pivot axis 115 at their mid-portions.

In the prior art chair 100 of FIG. 1, a sling seat bottom 110, which is formed from a flexible panel of material, traverses generally horizontally from the first side frame 102 to the second side frame 108. The sling seat bottom 110 has a first outboard edge coupled to the upper longitudinal frame member 112 near the first side frame 102 and a second outboard edge coupled to the upper longitudinal frame member 112 near the second side frame section 108. A sling seat back 106 traverses generally vertically between the side frame sections 102 and 108. Also formed from a flexible panel of material, the sling seat back 106 has first and second outboard edges coupled to the posts that form the canes 104.

By exploitation of the scissor-like arrangement established by the first and second cross-frame members 114, the wheelchair 100 can be adjusted from the use configuration shown in FIG. 1 to a folded configuration for storage and transport. When the wheelchair 100 is in a use configuration, the upper longitudinal frame members 112 are supported by the side frames 102 and 108. As the wheelchair 100 is collapsed, the first and second side frames 102 and 108 are moved toward one another thereby inducing a pivoting of the cross-frame members 114. The pivoting of the cross-frame members 114 yields a raising of the upper longitudinal frame members 112 in relation to the side frames 102 and 108. The upper longitudinal frame members 112 are also brought into proximity with one another.

As the wheelchair 100 is folded, the flexibility of the sling seat back and bottom 106 and 110 allows them to bend and fold thereby to facilitate the folding of the wheelchair 100. However, as noted above, the sling bottom and back 110 and 106 suffer from a plurality of disadvantages that must be overcome to provide an ergonomically proper seating arrangement for a seat occupant.

Figure 2:
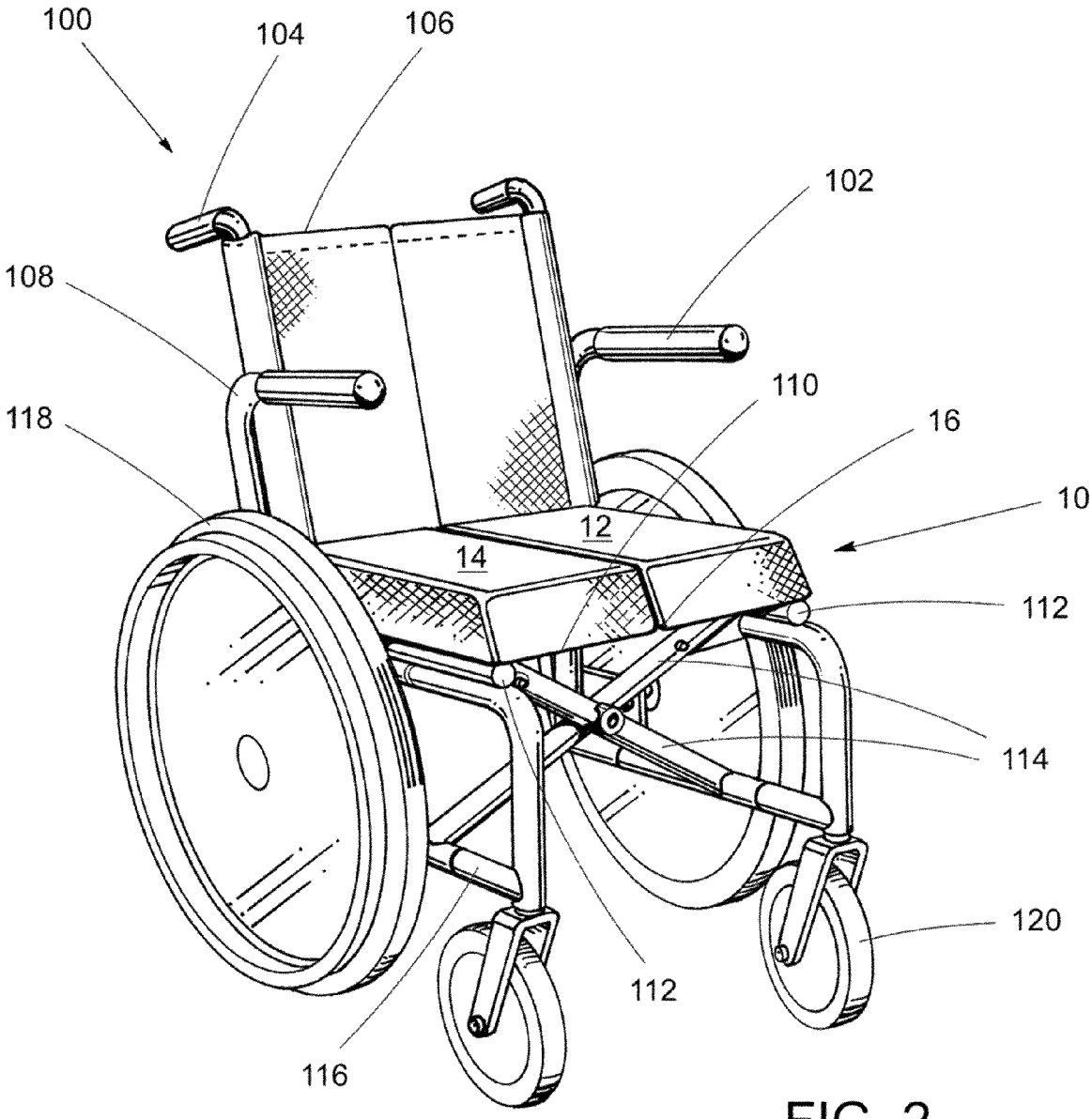
FIG. 2 is a perspective view of a foldable wheelchair employing a folding seat cushion pursuant to the present invention in a use configuration.
Figure 3:
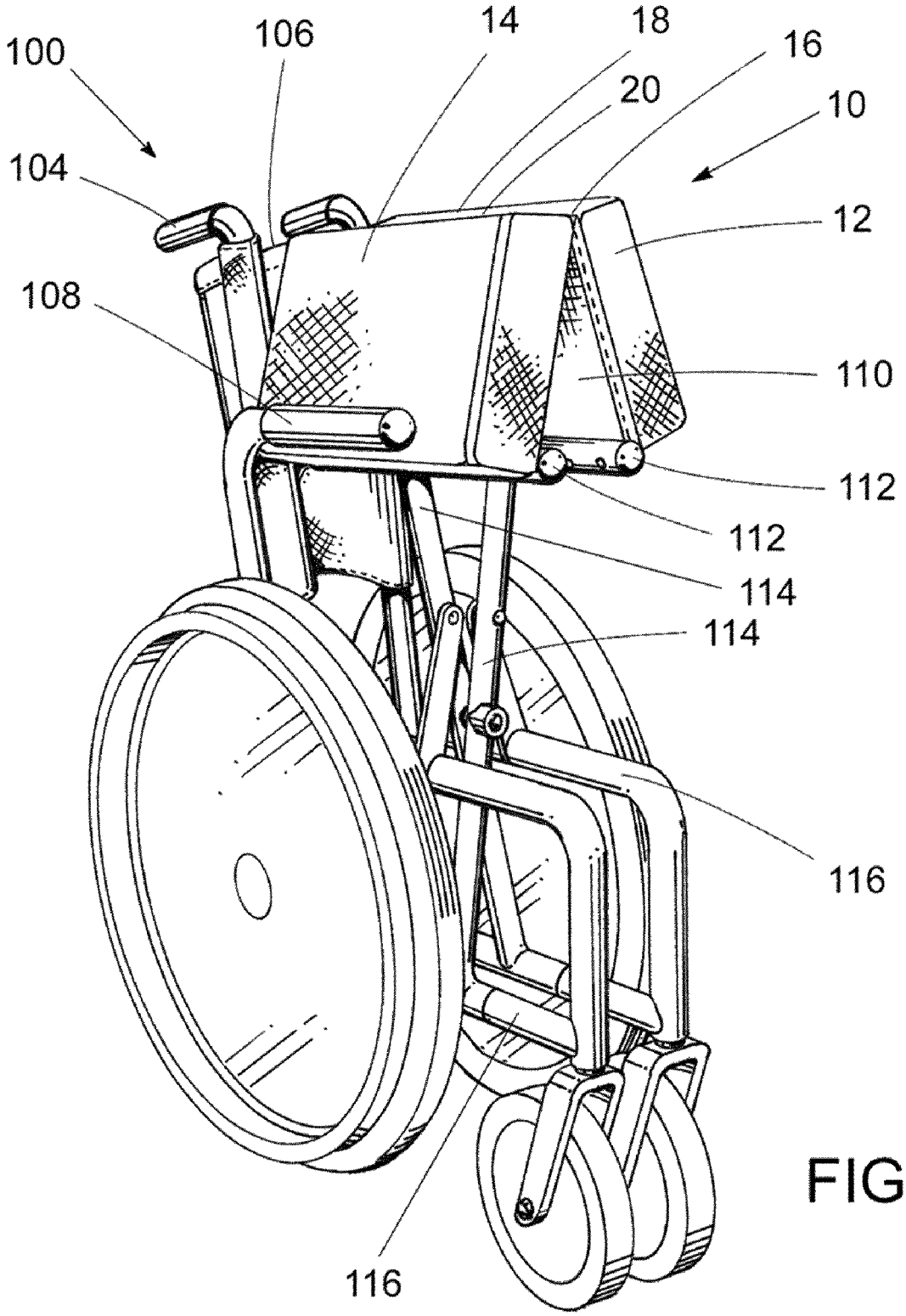
FIG. 3 is a perspective view of the foldable wheelchair of FIG. 2 in a partially folded configuration.
Figure 4:
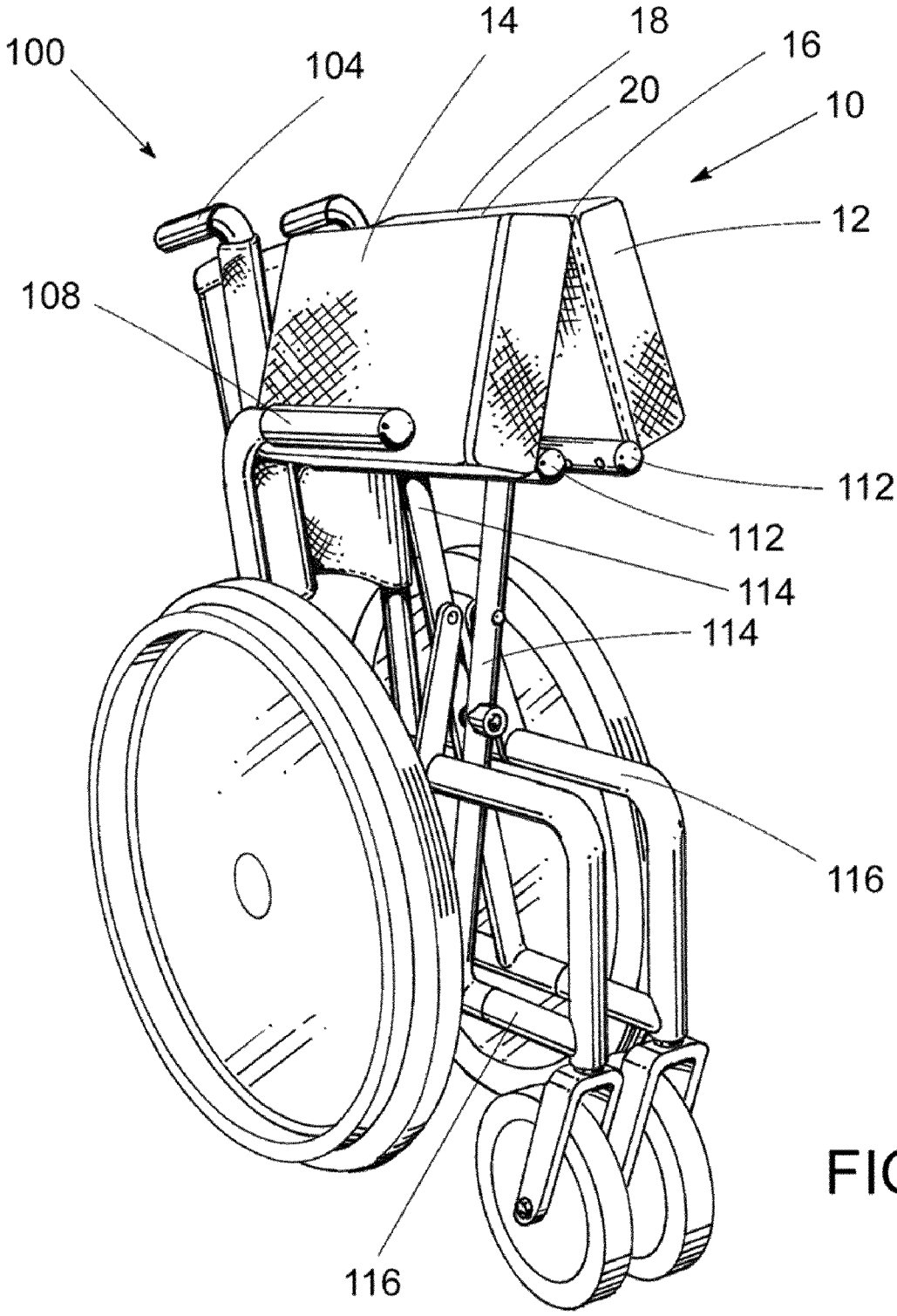
FIG. 4 is a perspective view of the foldable wheelchair of FIG. 2 in a fully folded configuration.

The present invention improves over these sling-type prior art arrangements by providing a foldable cushion 10 for use in relation to a foldable chair 100 that can supply the seat occupant with comfortable, ergonomically sound support. In FIGS. 2 through 4, the foldable cushion 10 is depicted in the form of a seat bottom cushion 10 applied to a wheelchair 100 as the wheelchair 100 progresses from a use configuration in FIG. 2, to a partially folded configuration in FIG. 3, and then to a fully folded configuration in FIG. 4.

As is depicted herein, the foldable cushion 10 could be employed to similar advantage in relation to a seatback. It will also be clear that, while the invention is primarily embodied in relation to a wheelchair 100, the foldable seat cushion 10 can be employed in relation to a wide variety of other foldable chairs, including, by way of example, folding lawn and beach chairs, casual furniture, children's furniture, and substantially any other folding seating construction having a similar cross-frame configuration.

As shown in FIGS. 2 through 4, the foldable cushion 10 taught herein can have a first lateral edge pivotally coupled to the upper longitudinal frame member 112 adjacent to the first side frame 102, a body portion traversing between the frames 102 and 108, and a second lateral edge pivotally coupled to the upper longitudinal frame member 112 adjacent to the second side frame 108. The cushion 10 can be attached edgewise to the upper longitudinal frame members 112 by any effective method, such as by a sleeve configuration that slides onto or is otherwise applied or coupled to the longitudinal frame members 112 to encase, partially encase, or merely attach to the frame members 112.

The foldable cushion 10 can be have a first cushion member 12 that is pivotally coupled to a second cushion member 14 by a hinge portion 16. The first and second cushion members 12 and 14 and the hinge portion 16 can be formed in any suitable manner as will be discussed hereinbelow. The first and second cushion members 12 and 14 can each be considered to have a support surface that is disposed to support a seat occupant, an obverse surface facing away from the seat occupant, and a given thickness between the support surface and the obverse surface. The hinge portion 16 in the depicted embodiment is disposed to the obverse surface side of the first and second cushion members 12 and 14 of the foldable cushion 10. As a result, the thickness of the cushion members 12 and 14 is interposed between the seat occupant and the hinge portion 16. With this, the risk of the hinge portion 16 impinging on the seat occupant is substantially obviated.

Furthermore, by forming the cushion 10 with the hinge portion 16 interposed between the first and second cushion members 12 and 14, the cushion 10 is foldable and permits the wheelchair 100 to be adjusted between the use configuration shown in FIG. 2 and the folded configuration depicted in FIG. 4 without a need for removing the cushion 10 from the chair 100. Where the cushion 10 is applied as a seat bottom, the hinge portion 16 of the cushion 10 can be pivoted relative to both converging side frames 102 and 108 upwardly as the wheelchair 100 is folded thereby to cause the cushion 10 to fold progressively until the disposition of FIG. 4 is reached.

As FIGS. 3 and 4 show, the first cushion member 12 can have an inboard face 18, and the second cushion member 14 can have an inboard face 20. When the cushion 10 is disposed in a flat, use configuration, the inboard faces 18 and 20 of the first and second cushion members 12 and 14 are disposed in substantial contact thereby to shield the seat occupant from contact with the hinge portion 16 or otherwise from being adversely affected by the pivotable coupling of the first and second cushion members 12 and 14.

One advantage derived from coupling the outboard edges of the foldable cushion 10 directly to the upper longitudinal frame members 112 is that weight applied to the seat formed by the foldable cushion 10 will tend to retain the wheelchair 100 in its use configuration. More particularly, the downward force on the upper longitudinal frame members 112 will exert leverage on the cross-frame members 114 biasing the upper ends of the cross-frame members 114 outwardly. With this, the wheelchair 100 will be prevented from inadvertently folding under the weight of the occupant. This too represents a departure from the prior art arrangements where the seats are typically coupled to the first and second side frames 102 and 108. Under those configurations, the weight of the seat occupant will naturally tend to pull the side frames 102 and 108 together thereby risking an inadvertent collapsing of the wheelchair 100 on the occupant. Collapsing could be sought to be prevented by the incorporation of a mechanical stop operably associated with the seat bottom, but the risk of failure leaves such constructions in need of improvement.

Also, with the foldable cushion 10 pivotally coupled to the upper longitudinal frame members 112 and with the hinge portion 16 disposed to the obverse side of the cushion 10, the outside edges of the first and second cushion members 12 and 14 will tend to rise with the upper longitudinal frame members 112 as the chair 100 is folded. The central portions of the cushion members 12 and 14 and the hinge 16 will rise still further as the cushion members 12 and 14 are pivoted to a folded configuration as shown in FIG. 4 with the hinge portion 16 rising above the cushion members 12 and 14 as in an upside-down V configuration. As a result, the cushion 10 will be moved to a non-obtrusive position when the chair 100 is collapsed as shown in FIG. 4, and the thickness of the cushion 10 will be prevented from interfering with the complete folding of the chair 100. This represents a departure from the prior art where the seats tend to remain disposed between the first and second frames 102 and 108 whereby any substantial thickness of the seat prevents complete folding of the chair 100.

Figure 17:
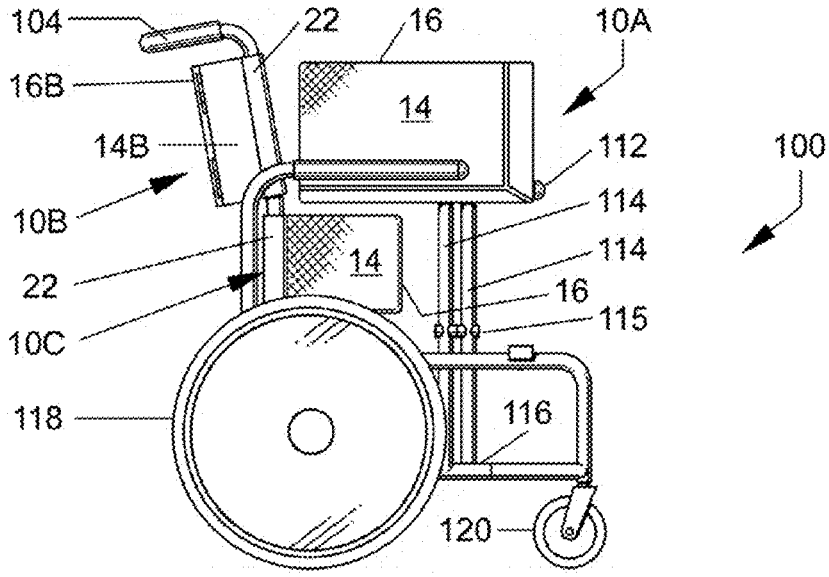
FIG. 17 is a view in side elevation of a collapsible wheelchair incorporating a foldable seat and a bifurcated foldable seatback.

The present inventors have appreciated that, while the raising of the foldable seat bottom when the chair 100 is folded is advantageous as described above, its location above the longitudinal frame members 12 could present an obstruction where a foldable seatback is employed that folds to assume a position anterior to the canes 104. One arrangement for addressing the problem can be appreciated by reference to FIG. 17 where a foldable chair 100 is depicted in a folded configuration. A first foldable seat bottom cushion 10A has first and second side edges retained relative to the upper longitudinal members 112 in this case by mechanical fasteners 56, and the first and second cushion members 12 and 14 are shown pivoted about the hinge 16 to a raised position. In this embodiment, however, the seatback cushion arrangement can be considered to be bifurcated into first and second seatback cushions 10B and 10C. With this, the lower seatback cushion 10C, which again is foldable, can pivot anteriorly under the raised seat bottom without interference. As a result, the lower seatback cushion 10C will tend not to interfere with the storage and transportation of the folded chair 100. The upper seatback cushion 10B, however, can be prevented from interfering with the folded seat bottom cushion 10A either by folding posteriorly or by being formed in a multi-hinged arrangement as in FIGS. 18 and 19.

Figure 18:
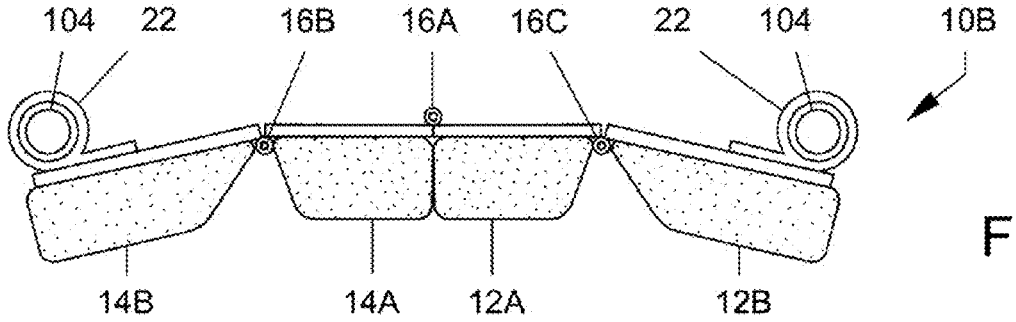
FIG. 18 is a top plan view of a foldable seatback according to the present invention in a use configuration.
Figure 19:
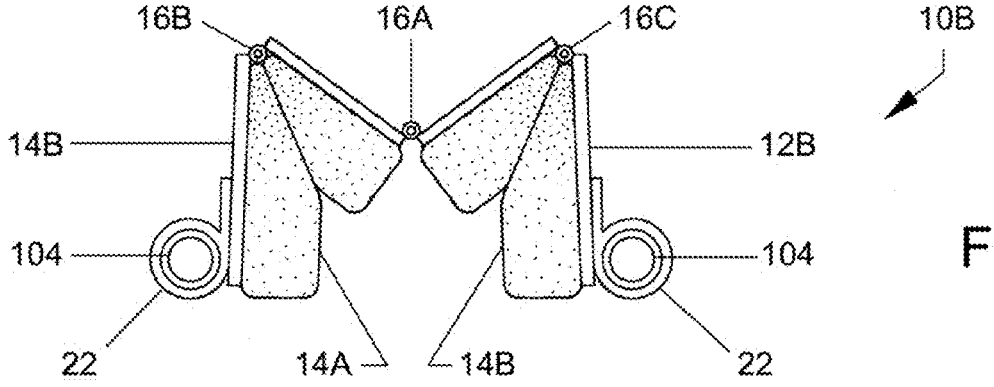
FIG. 19 is a top plan view of the foldable seatback of FIG. 18 in a folded configuration.

As shown in FIGS. 18 and 19, the upper seatback cushion 10B has a central hinge 16A, a first side hinge 16B, and a second side hinge 16C. With this, the inner and outer first side cushion members 12A and 12B are established, and inner and outer second side cushions 14A and 14B are established. Under this arrangement, the upper seatback cushion 10B can be folded as in FIG. 19 where the inner and outer first side cushion members 12A and 12B are in a facing relationship and the inner and outer second side cushions 14A and 14B are in a facing relationship. The folded upper seatback cushion 10B thus requires less longitudinal space and avoids contacting the seat bottom cushion 10A while still providing comfortable support to the seat occupant when in a use configuration.

The first and second cushion members 12 and 14 under the present invention can be formed of any suitable material or materials. By way of example and not limitation, the cushion members 12 and 14 can incorporate foam, gel, viscoelastic material, gas-filled chambers, or any combination thereof. Where necessary or desirable, the bodies of the first and second cushion members 12 and 14 can be encased in a cover of suitable material, such as vinyl, neoprene, leather, fabric, or plastic. The entire cushion 10 or merely the cover thereof can be removable for cleaning, replacement, and the like.

Figure 5:
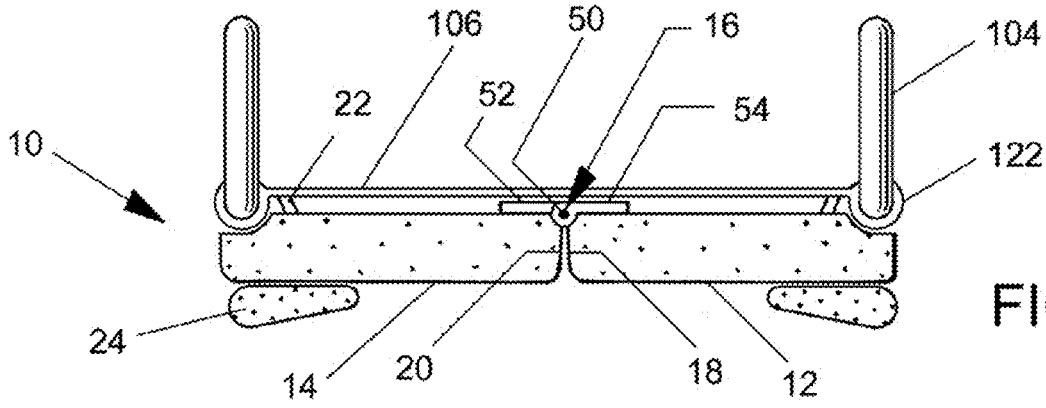
FIG. 5 is a top plan view of a seatback construction according to the instant invention shown in relation to the canes of a foldable wheelchair.

As one can perceive by additional reference to FIG. 5 where the cushion 10 is employed as a seatback cushion 10, the cushion 10 can have outboard edges coupled to the vertical rods, tubes, or struts of the canes 104. The foldable cushion 10 overlies the original sling back 106, which is retained relative to the vertical rods of the canes 104 by looped end portions 122. The cushion 10 is held in place by fasteners 22, which can take any effective form. For example, the cushion 10 can be retained by sleeves, hook and loop material, string fasteners, or any other type of fastening means or combination thereof. With the foldable cushion 10 so disposed, the hinge portion 16 and the inboard edges 18 and 20 of the first and second cushion members 12 and 14 can move anteriorly to allow the cushion 10 or a portion thereof to be folded thereby to permit the wheelchair 100 to be folded. As FIG. 5 further shows, supplemental ergonomic padding 24, here in the form of lateral support pads, can be affixed to the cushion 10, such as to the outer edges thereof to enhance the comfort and support provided to the user.

Figure 6:
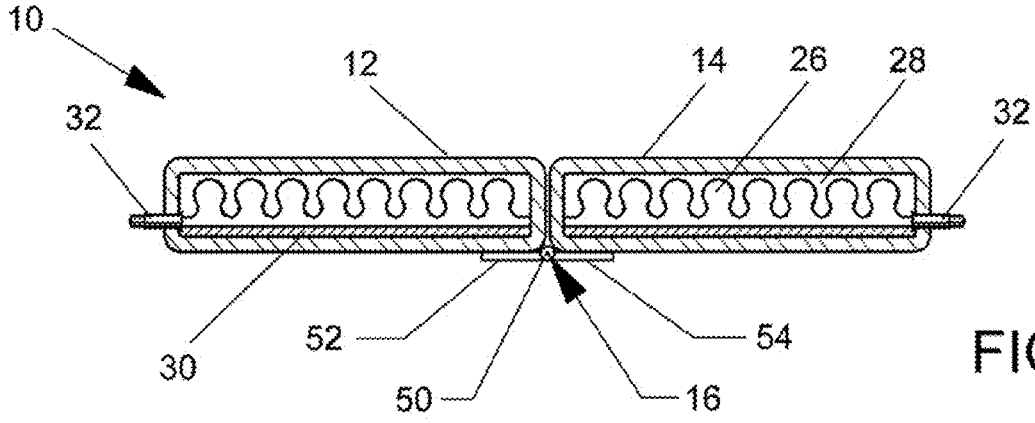
FIG. 6 is a cross sectional view of an alternative foldable cushion according to the invention disclosed herein.

As FIG. 6 shows, a foldable cushion 10 according to the present invention can have an open inner volume 26 that can be filled with any suitable gas, liquid, gel, or combination thereof. Closable apertures 32 can be provided in the first and second cushion members 12 and 14 for enabling the addition or retraction of material relative to the open inner volume 26. Where necessary or desirable, rigidifying cross members 28 can traverse the open inner volume 26 whereby the cushion 10 can maintain structural integrity while allowing the rigidity and hardness of the cushion members 12 and 14 to be adjusted to suit the needs and desires of the seat occupant by the insertion and removal of fluid from the open inner volume 26.

Figure 7:
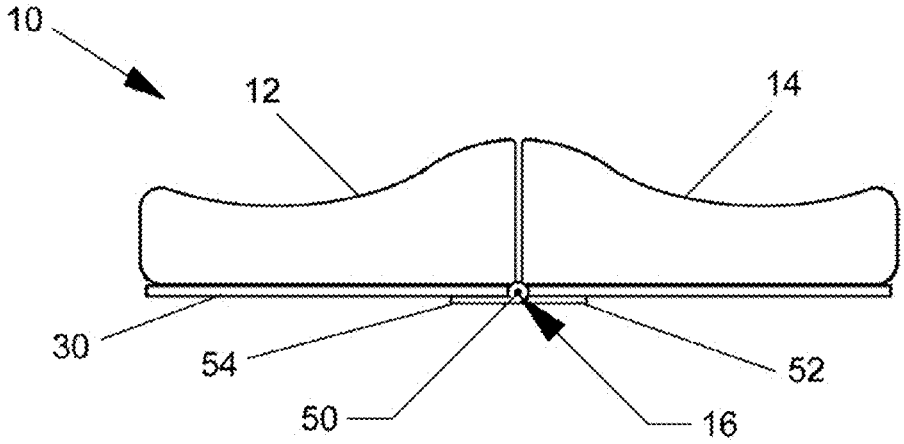
FIG. 7 is a view in front elevation of an alternative foldable cushion according to the invention.

To ensure that the first and second cushion members 12 and 14 maintain their shape, rigidifying panels 30 can be incorporated within or coupled to the cushion members 12 and 14. As shown in FIG. 6, the rigidifying panels 30 can be incorporated within the cushion members 12 and 14. Alternatively, as shown in FIG. 7, the rigidifying panels 30 can be fixed as backing members to the cushion members 12 and 14. The rigidifying panels 30 can be formed from any suitable material. By way of example and not limitation, the rigidifying panels 30 can comprise panels of plastic, wood, particle board, or any other suitable material.

The hinge portion 16 can take a wide variety of forms within the scope of the invention. For example, as shown in FIGS. 5 through 7, the hinge portion 16 can comprise an elongate butt-style hinge. As such, the hinge portion 16 can have a central body 50 portion that communicates along the midline defined by the inboard faces 18 and 20 of the first and second cushion members 12 and 14, a first wing 52 fixed to the first cushion member 12, and a second wing 54 fixed to the second cushion member 14.

Figure 8:
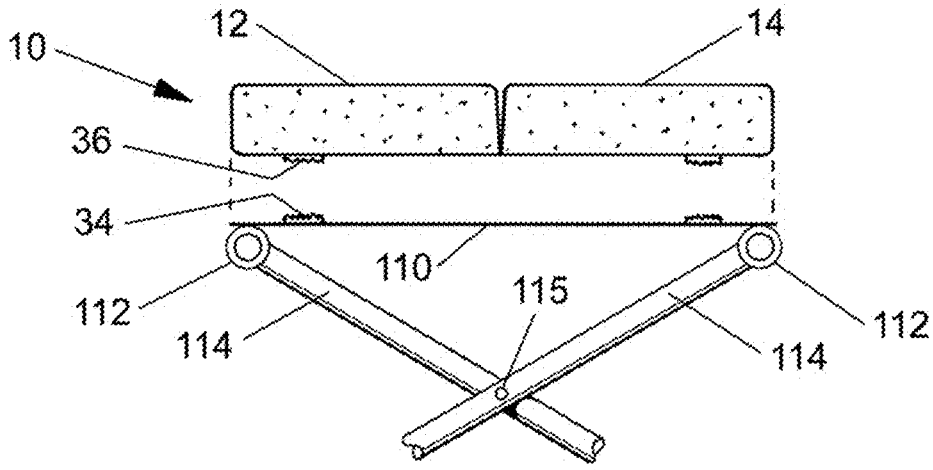
FIGS. 8 through 16 are views in front elevation of further alternative foldable cushions pursuant to the invention disclosed herein.

As shown in FIG. 8, a traditional sling seat bottom 110 can be coupled to the upper longitudinal members 112, which in turn are retained at the upper ends of the cross-frame members 114. The cross-frame members 114 are pivotally coupled at a pivot axis 115. A cushion 10 under the present invention could be fastened to the seat bottom 110 by sections of hook material 34 applied to the seat bottom 110 in combination with sections of loop material 36 applied to the obverse side of the first and second cushion members 12 and 14.

Figure 9:
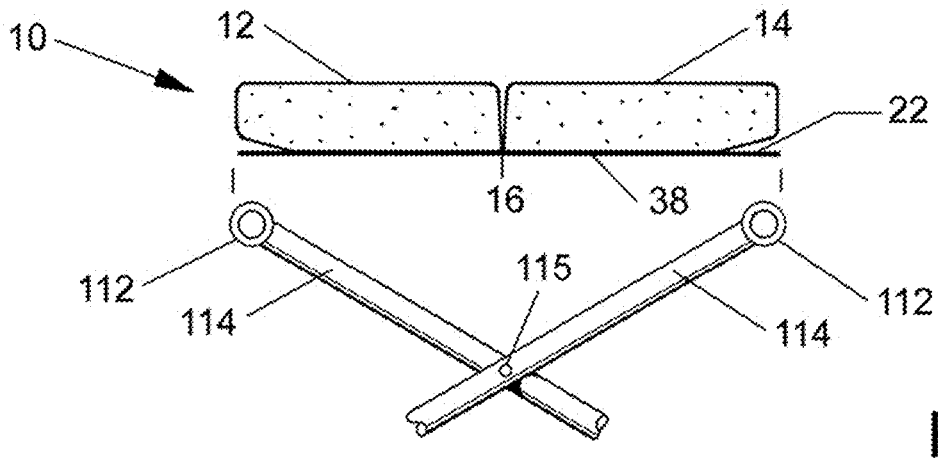

In the embodiment of FIG. 9, the first and second cushion members 12 and 14 are retained, such as by adhesive, sewing, or otherwise, to a base web 38 that traverses from outboard edge to outboard edge of the cushion members 12 and 14. As such, the base web 38, which could be formed from fabric, polymer, or another material or combination thereof, acts as the hinge portion 16. The outboard edges of the base web 38 can act as loop members 22 to wrap around the upper longitudinal members 112.

Figure 10:
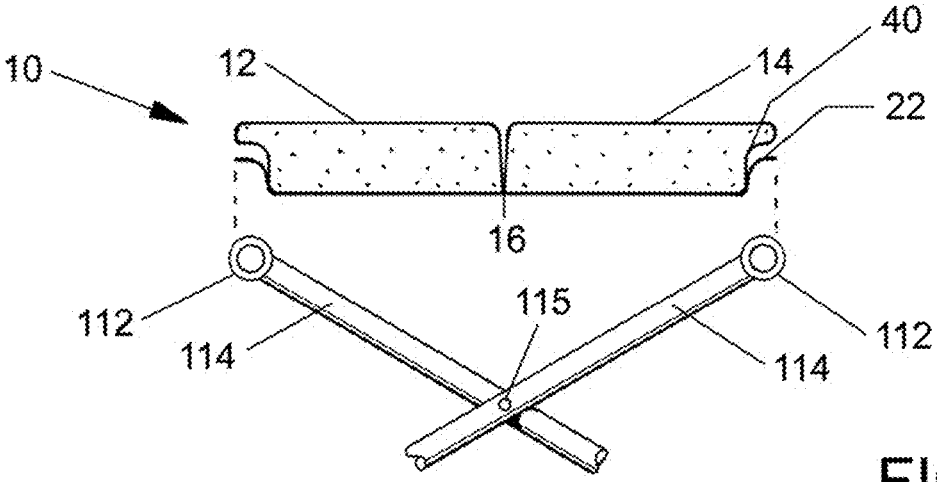

Looking to FIG. 10, embodiments of the foldable cushion 10 are contemplated wherein the first and second cushion members 12 and 14 have channels 40 disposed in the outboard edges thereof. With this, the foldable cushion 10 can be partially received between the upper longitudinal members 112. Loop members 22 are fixed adjacent to the channels 40 for retaining the foldable cushion 10 relative to the upper longitudinal members 112. Rigidifying panels, not shown, can again be included within the first and second cushion members 12 and 14.

Figure 11:
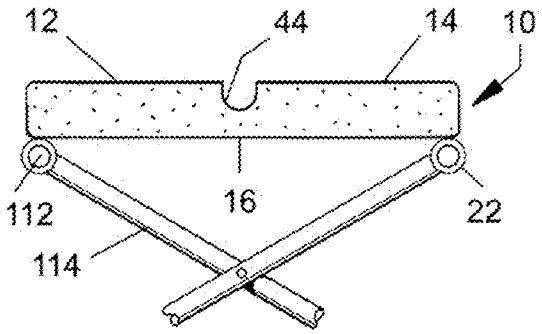
Figure 12:
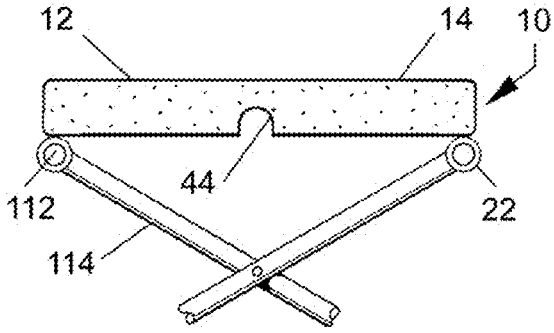
Figure 14:
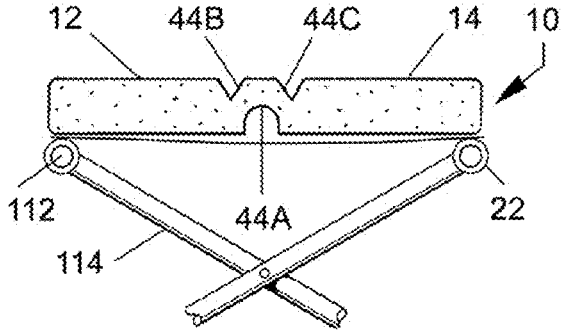

As one can perceive from, for example, the embodiments of FIGS. 11, 12, and 14, the hinge portion 16 could be formed from the material forming the first and second cushion members 12 and 14 themselves such that the first and second cushion members 12 and 14 could form a unitary member of, for example, foam or the like so long as at least one defined hinge portion 16 is incorporated. In FIG. 11, the hinge portion 16 comprises a thinned portion created by a longitudinal furrow 44 interposed between the cushion members 12 and 14 to the upper or anterior side thereof. The cushion 10 is retained relative to the longitudinal cross-frame members 112 by loops 22 disposed at the outboard edges of the cushion 10. In FIG. 12, however, the furrow 44 is disposed to the obverse side of the cushion 10. In the embodiment of the foldable cushion 10 of FIG. 14, a first longitudinal furrow 44A is formed in the center of the obverse side of the cushion 10, and second and third longitudinal furrows 44B and 44C are disposed in the upper surface of the cushion 10 slightly outboard of the first longitudinal furrow 44A. With this, first and second cushion members 12 and 14 are effectively formed, and the furrows 44A, 44B, and 44C effectively act as the hinge between the cushion members 12 and 14.

Figure 13:
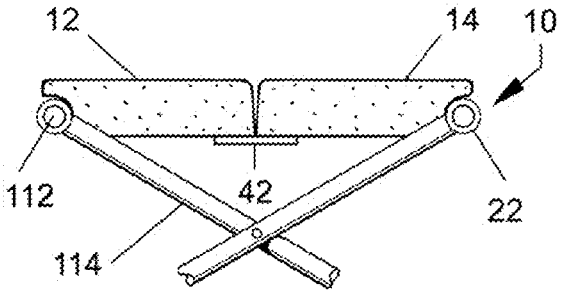

In FIG. 13, the first and second cushion members 12 and 14 are hingedly coupled by a web 42 that can be made of cloth, canvas, flexible sheet rubber, or otherwise. The web 42 has a first wing coupled to the first cushion member 12 and a second wing coupled to the second cushion member 14.

Figure 15:
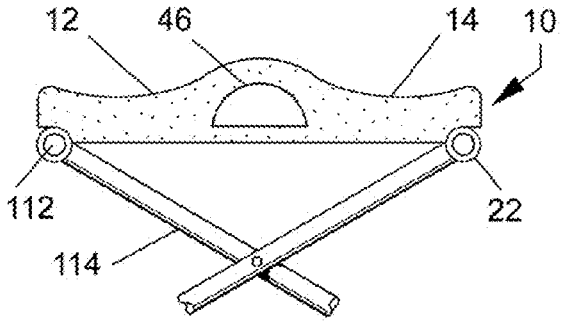
Figure 16:
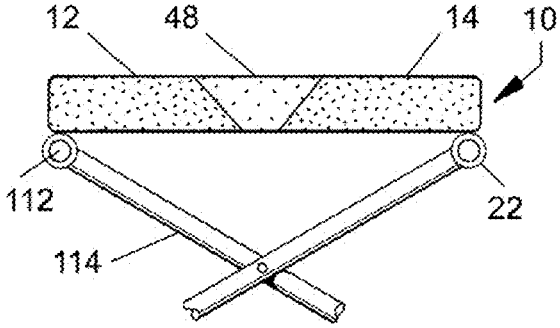

In the embodiment of FIG. 15, the first and second cushion members 12 and 14 are allowed to pivot relative to one another by an interposed longitudinal void 46 between the first and second cushion members 12 and 14. The void 46 could be entirely empty or filled with a relatively low density material, such as a lighter foam where the first and second cushion members 12 and 14 are formed from foam. Finally, the embodiment of FIG. 16 has a longitudinal section 48 of secondary, disparate material interposed between the material forming the first and second cushion members 12 and 14. The section 48 of secondary material, which can be disposed within a furrow to the obverse side of the cushion 10, can be of a low density material in comparison to the material forming the first and second cushion members 12 and 14. With this, the secondary material can fold during a folding of the cushion 10 thereby to act as a hinge.

It will be clear that the cushion 10 can be of any shape and size pursuant to the invention depending on, for example, the dimensions of the wheelchair, the goals of the user, and the bodily shape and size of the user. By way of example and not limitation, the cushion 10 can have ergonomic contouring to accommodate a seat occupant's legs, posterior, back, or the like. The cushion 10 can have a waterfall forward edge and a ridged rear portion for optimal comfort and stability.

With certain details of the present invention disclosed, it will be understood by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventors. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof that might be now known or hereafter discovered.

We claim as deserving the protection of Letters Patent:

1. A foldable seat for a foldable wheelchair with a foldable wheelchair frame comprising a first side frame and a second side frame wherein the foldable wheelchair frame can be adjusted from a use configuration to a folded configuration by a movement of the first and second side frames toward one another, the foldable seat comprising:

a foldable seat with a first outside edge, a second outside edge, and a longitudinal hinge portion interposed between the first and second outside edges to divide the seat into first and second members that are pivotally coupled at the hinge portion whereby the first outside edge can be retained relative to the first side frame and the second outside edge can be retained relative to the second side frame wherein the first and second members comprise members of resiliently compressible material, wherein each of the first and second members of the seat has a support surface side that is disposed to support a seat occupant, an opposite side disposed to face away from the seat occupant, and a given thickness between the support surface and the opposite surface and wherein the hinge portion is formed by at least first and second longitudinal furrows in the foldable seat between the first and second members of the seat wherein the first and second furrows are disposed to one side of the foldable seat;

whereby the foldable wheelchair frame can be adjusted from a use configuration to a folded configuration to yield a folding of the foldable seat about the hinge portion.

2. The foldable seat for a foldable wheelchair of claim 1 wherein a longitudinal furrow is disposed to a first side of the foldable seat and the first and second furrows are disposed to a second side of the foldable seat outboard of the furrow disposed to the first side of the foldable seat.

3. The foldable seat for a foldable wheelchair of claim 2 wherein the first and second furrows are disposed to the support surface side of the first and second members of the seat.

4. A foldable seat for a foldable wheelchair with a foldable wheelchair frame comprising a first side frame and a second side frame wherein the foldable wheelchair frame can be adjusted from a use configuration to a folded configuration by a movement of the first and second side frames toward one another, the foldable seat comprising:

a foldable seat with a first outside edge, a second outside edge, and a longitudinal hinge portion interposed between the first and second outside edges to divide the seat into first and second members that are pivotally coupled at the hinge portion whereby the first outside edge can be retained relative to the first side frame and the second outside edge can be retained relative to the second side frame wherein the first and second members comprise members of resiliently compressible material, wherein each of the first and second members of the seat has a support surface that is disposed to support a seat occupant, an opposite surface disposed to face away from the seat occupant, and a given thickness between the support surface and the opposite surface and wherein the hinge portion is formed by a longitudinal void enclosed within the foldable seat between the first and second members of the seat;

whereby the foldable wheelchair frame can be adjusted from a use configuration to a folded configuration to yield a folding of the foldable seat about the hinge portion.

5. The foldable seat for a foldable wheelchair of claim 4 wherein the first and second members comprise members of foam material and wherein the void is filled with a lighter foam material than the foam material of the first and second members.

6. A foldable seat for a foldable wheelchair with a foldable wheelchair frame comprising a first side frame and a second side frame wherein the foldable wheelchair frame can be adjusted from a use configuration to a folded configuration by a movement of the first and second side frames toward one another, the foldable seat comprising:

a foldable seat with a first outside edge, a second outside edge, and a longitudinal hinge portion interposed between the first and second outside edges to divide the seat into first and second members that are pivotally coupled at the hinge portion whereby the first outside edge can be retained relative to the first side frame and the second outside edge can be retained relative to the second side frame wherein the first and second members comprise members of resiliently compressible material, wherein each of the first and second members of the seat has a support surface that is disposed to support a seat occupant, an opposite surface disposed to face away from the seat occupant, and a given thickness between the support surface and the opposite surface, wherein the hinge portion is formed by a disparate material disposed in the foldable seat to connect the first and second members of resiliently compressible material of the seat, and wherein the disparate material forming the hinge portion has a lower density in comparison to the resiliently compressible material of the first and second members;

whereby the foldable wheelchair frame can be adjusted from a use configuration to a folded configuration to yield a folding of the foldable seat about the hinge portion.

7. The foldable seat for a foldable wheelchair of claim 6 further comprising a foldable wheelchair frame with a first side frame, a second side frame, and a cross frame arrangement interposed between the first and second side frames wherein the cross frame arrangement is formed by first and second cross-frame members wherein the first cross-frame member has a lower, first end pivotally coupled to the first side frame, the second cross-frame member has a lower, first end pivotally coupled to the second side frame, the first and second cross-frame members are pivotally coupled to one another at mid-portions thereof, and the first and second cross-frame members have upper, second ends and a first longitudinal frame member retained at the upper, second end of the first cross-frame member and a second longitudinal frame member retained at the upper, second end of the second cross-frame member wherein the first and second outside edges of the foldable seat are coupled to the first and second longitudinal frame members respectively.

8. The foldable seat for a foldable wheelchair of claim 7 further comprising a foldable seatback with a first outside edge, a second outside edge, and a hinge portion interposed between the first and second outside edges to divide the seatback into first and second members that are pivotally coupled at the hinge portion wherein the first outside edge is retained relative to the first side frame and the second outside edge is retained relative to the second side frame.

9. The foldable seat for a foldable wheelchair of claim 8 wherein there is an upper foldable seatback and a lower foldable seatback.

10. The foldable seat for a foldable wheelchair of claim 9 wherein the upper foldable seatback has a plurality of members pivotally coupled by plural interposed hinges.

11. The foldable seat for a foldable wheelchair of claim 10 wherein the upper foldable seatback has a central hinge, a first side hinge, and a second side hinge whereby inner and outer first side members are established and inner and outer second side members are established.

12. The foldable seat for a foldable wheelchair of claim 6 wherein the resiliently compressible material of the first and second members comprises foam.

13. A foldable, cross-frame wheelchair with a foldable seatback comprising:

a foldable wheelchair frame with a first side frame and a second side frame wherein the first and second side frames are movable into and out of proximity with one another whereby the foldable wheelchair frame can be adjusted from a use configuration to a folded configuration by a movement of the first and second side frames toward one another;

a lower foldable seatback with a first outside edge, a second outside edge, and a hinge portion interposed between the first and second outside edges to divide the seatback into first and second members that are pivotally coupled at the hinge portion wherein the first outside edge is retained relative to the first side frame and the second outside edge is retained relative to the second side frame; and an upper foldable seatback with a first outside edge, a second outside edge, and a hinge portion interposed between the first and second outside edges to divide the seatback into first and second members that are pivotally coupled at the hinge portion wherein the first outside edge is retained relative to the first side frame and the second outside edge is retained relative to the second side frame.

14. The foldable, cross-frame wheelchair with a foldable seatback of claim 13 wherein the upper foldable seatback has a plurality of members pivotally coupled by plural interposed hinges.

15. The foldable, cross-frame wheelchair with the foldable seatback of claim 14 wherein the upper foldable seatback has a central hinge, a first side hinge, and a second side hinge whereby inner and outer first side members are established and inner and outer second side members are established.

* * * * *